US012133594B2

(12) United States Patent
Wright

(10) Patent No.: US 12,133,594 B2
(45) Date of Patent: Nov. 5, 2024

(54) CONVERTIBLE BEACH SEAT AND METHOD OF FORMING A BEACH SEAT IN A BEACH

(71) Applicant: Anthony D. Wright, Wilmington, DE (US)

(72) Inventor: Anthony D. Wright, Wilmington, DE (US)

( * ) Notice: Subject to any disclaimer, the term of this patent is extended or adjusted under 35 U.S.C. 154(b) by 0 days.

(21) Appl. No.: 18/652,128

(22) Filed: May 1, 2024

(65) Prior Publication Data

US 2024/0277148 A1 Aug. 22, 2024

Related U.S. Application Data

(63) Continuation of application No. PCT/US2022/048621, filed on Nov. 1, 2022.

(60) Provisional application No. 63/274,339, filed on Nov. 1, 2021.

(51) Int. Cl.

| | |
|---|---|
| ***A47C 1/14*** | (2006.01) |
| ***A47C 4/28*** | (2006.01) |
| ***A47C 7/54*** | (2006.01) |
| ***A47C 13/00*** | (2006.01) |

(52) U.S. Cl.

CPC ..... *A47C 1/146* (2013.01); *A47C 4/28* (2013.01); *A47C 7/546* (2013.01); *A47C 13/005* (2013.01)

(58) Field of Classification Search

None

See application file for complete search history.

(56) References Cited

U.S. PATENT DOCUMENTS 2,857,957 A 10/1958 Gay
3,808,616 A 5/1974 White
(Continued)

FOREIGN PATENT DOCUMENTS

GB 926425 A * 5/1963

OTHER PUBLICATIONS

Beach Bliss Living. "The Most Amazing Sand Castles & Funny Sand Sculptures" [online]. Oct. 24, 2021; Retrieved from the internet: URL: <https://web.archive.org/web/20211024205648/https://Beachblissliving.com/amazing-sand-castles-funny-sand-sculptures/> [Retrieved Nov. 20, 2023] (27 pages).
(Continued)

*Primary Examiner* — David E Allred
(74) *Attorney, Agent, or Firm* — Devlin Law Firm LLC

(57) ABSTRACT

A convertible beach seat system allows a user to form an arrangement of coupled together beach seats and armrests. Also, a method of forming a beach seat in a beach includes digging a trough or trench for receiving the leg portion of the beach seat and forming a sand-mound back rest for the back portion of the beach set to rest thereon. The beach seat system includes a plurality of beach seats, each having a back portion, a seat portion and a leg portion that are pivotably connected about hinges. Each of the beach seats have attachment apertures along the sides for detachably attaching beach seats together by the insertion of attachment posts that extend between the coupled beach seats. Armrests may be detachably attached to the beach seats. Attachment posts are provided for insertion into attachment apertures to coupled together beach seats or armrests to a beach seat.

25 Claims, 9 Drawing Sheets

(56) References Cited

U.S. PATENT DOCUMENTS

| | | | | | |
|---|---|---|---|---|---|
| 3,955,849 | A * | 5/1976 | Grebow | A47C 1/146 297/183.1 |
| 5,042,874 | A | 8/1991 | Williams | |
| 5,265,292 | A * | 11/1993 | Underell | A47C 4/52 5/419 |
| 5,890,767 | A * | 4/1999 | Chang | A47C 7/546 297/440.22 |
| 5,975,630 | A * | 11/1999 | Schreiber | A47C 1/14 297/217.3 |
| 8,960,784 | B1 | 2/2015 | De Berry | |
| 11,147,385 | B1 * | 10/2021 | Kuhl | A47C 17/86 |
| 2006/0282949 | A1 * | 12/2006 | Karen | A47B 85/00 5/419 |
| 2008/0178391 | A1 * | 7/2008 | Andrade | A47C 1/146 5/705 |
| 2017/0065093 | A1 * | 3/2017 | Scorgie | A45C 3/001 |
| 2017/0332793 | A1 * | 11/2017 | Caluwaert | A47C 1/146 |
| 2018/0289163 | A1 * | 10/2018 | Clark | A47C 7/021 |
| 2022/0104624 | A1 * | 4/2022 | Erdman | A47C 4/028 |
| 2023/0284783 | A1 * | 9/2023 | Mason | A47C 7/407 |

OTHER PUBLICATIONS

International Search Report for PCT/US2022/048621, issued Feb. 10, 2023 (3 pages).

Written Opinion for PCT/US2022/048621, issued Feb. 10, 2023 (6 pages).

* cited by examiner

CONVERTIBLE BEACH SEAT AND METHOD OF FORMING A BEACH SEAT IN A BEACH

This application is a bypass continuation application of PCT Application No. PCT/US2022/048621, filed Nov. 1, 2022, which claims the priority of U.S. Provisional Patent Application No. 63/274,339, filed on Nov. 1, 2021.

BACKGROUND OF THE INVENTION

Field of the Invention

The invention relates to a convertible beach seat system that allows a user to form an arrangement of coupled together beach seats and armrests and a method of forming a beach seat in a beach by digging a trough or trench for receiving the leg portion of the beach seat and forming a sand-mound back rest for the back portion of the beach set to rest thereon.

Background

Beach chairs are conventionally configured to rest on the beach surface and have braces to retain a back portion at a desired angle with respect to the seat portion. The mechanism to retain the back or leg portion in a desired angular orientation with respect to the seat are hard to manipulate, can pinch fingers and add weight to the beach chair.

SUMMARY OF THE INVENTION

The invention is directed to a convertible beach seat system that allows a user to form an arrangement of coupled together beach seats and armrests and a method of forming a beach seat in a beach by digging a trough or trench for receiving the leg portion of the beach seat and forming a sand-mound back rest for the back portion of the beach set to rest thereon. The beach seat system may comprise a plurality of beach seats, each having a back portion, a seat portion and a leg portion that are pivotably connected about hinges. Each of the beach seats have attachment apertures along the sides for detachably attaching beach seats together by the insertion of attachment posts that extend between the coupled beach seats. Also, armrests may be detachably attached to the beach seats by the insertion of attachment posts into armrest attachment apertures and then extending the post into an attachment aperture of a beach seat.

Each of the beach seats may be configured to fold to stack the back portion, seat portion and leg portion over each other in a parallel arrangement. Each beach seat may have a back portion having a back frame and may have a back cushion, a seat portion having a seat frame and may have a seat cushion, and a leg portion having a leg frame and may have a leg cushion. Each of the back, seat and leg portions may be detachably attached to the frame and may be detachably attached to each other. A seat-back hinge is configured between the back portion and seat portion to allow the back portion to pivot or fold with respect to the seat portion. A seat-back hinge plate may have a length to allow the back portion to fold down over the leg portion. A seat-leg hinge is configured between the seat portion and the leg portion to allow the leg portion to pivot or fold with respect to the seat portion. Each of the back portion and leg portion may be configured to fold over and overlap at least a portion of the seat portion. In some embodiments, the leg portion may first fold over and overlap the seat portion, and then the back portion may fold over and overlap the leg portion.

The method of forming a beach seat may further comprise providing a beach. The beach may comprise sand and a beach surface. The method of forming a beach seat may comprise digging a trough or trench down into the surface of the beach. The trough may comprise a front wall, a back wall, a width between the front and back walls, and a depth. The width between the front and back walls may be effectively wide to walk therein. In other words, the width of the trough may be wide enough for a person to walk within the through such that the sides of the person are adjacent to the front and back walls of the trough. The width of the trough may be effectively wide to walk therein and therefore may be about 25 cm or more, about 40 cm or more, about 50 cm or more about 75 cm or more about 1 m or more and any range between and including the widths provided. The depth of the trough may be at least as deep as the length of the leg portion of the foldable beach seat from the leg-seat end of the leg portion to the leg-extended end of the leg portion, or about 30 cm or more, about 40 cm or more, about 50 cm or more, about 70 cm or more and any range between and including the depths provided. In some embodiments, the back wall may be formed as a vertical wall. In other embodiments, the back wall be formed at various degrees of incline from the bottom of the trough to a top surface of the beach.

The method of forming a beach seat may further comprise mounding sand to form a sand-mound back rest. The sand mound may be formed an offset-seat distance from the back wall of the trough. In some embodiments, the offset-seat distance may be the same distance as the width of the trough. In some embodiments, the offset-seat distance may be the same distance as a length of the seat portion of the first foldable beach chair. The method of forming a beach seat may further comprise placing the leg portion of the first foldable beach seat down into the trough along the back wall and also placing the back portion against the sand-mound back rest. In some embodiments, the sand mound may be formed as a vertical wall upon which the back portion of the first foldable beach seat may be configured. In other embodiments, the sand mount may be formed in various degrees of incline form the top surface of the beach. The sand-mound back rest may have a height from the beach surface hat is effectively high to support the back rest and may be at least about 25 cm or more about 40 cm or more, about 50 cm or more, about 60 cm or more, about 75 cm or more and any range between and including the sand-mound back rest heights provided.

The first foldable beach seat may comprise a back pivot between the back portion and the seat portion, and may further comprise a leg pivot between the leg portion and the seat portion. Said pivots may be formed by hinges comprising hinge plates.

An armrest may be detachably attachable to the first foldable beach seat. The armrest may be configured to extend from the back portion along the seat portion of the first foldable beach seat. The armrest may comprise armrest attachment apertures that may be configured to detachably attach to the armrest to the beach seat via attachment posts.

The beach seats may have a plurality of attachment apertures for receiving an attachment post to couple a second beach seat thereto, or an armrest thereto. A beach seat may have one or more attachment apertures coupled to the frame to form back attachment apertures, seat attachment apertures, and leg attachment apertures. A back attachment aperture may be configured proximal to the extended end of the back portion and a leg attachment aperture may be configured proximal to the extended end of the leg portion. The seat portion may have seat attachment apertures proximal to the back and leg portions. Both foldable beach seats may comprise attachment apertures such as back attachment apertures, seat attachment apertures, and leg attachment apertures, that may be used to receive one end each of an attachment post. The number of back attachment apertures on the back portions of both the first foldable beach seat and second foldable beach seat may be anywhere from 0 to 5. The number of seat attachment apertures on the seat portions of both the first foldable beach seat and second foldable beach seat may be anywhere from 0 to 5. The number of leg attachment apertures on the leg portions of both the first foldable beach seat and second foldable beach seat may be anywhere from 0 to 5. Also, attachment apertures may be configured in the hinges or hinge plates between the back, seat and leg portions. A seat-back hinge attachment aperture may be configured in the seat-back hinge plate configured between the seat portion and back portion and a seat-leg attachment aperture may be configured in the seat-leg hinge plate configured between the leg portion and the seat portion. The hinge plates may provide a stable and secure location for the attachment aperture as it may be a fixed position during pivoting or folding the back or leg portions.

The attachment posts for coupling beach seats together and/or armrests to the beach seat may be configured for insertion into the attachment apertures. The attachment posted may have a flared end or an end with a flange that is slightly larger in diameter, which may aid securing the attachment post within an attachment aperture. An attachment post may have a cylindrical cavity that can be compresses for insertion into an attachment aperture and may have a slot extending along a portion of the entire length of the attachment post to enable the attachment post to be compressed and reduced in diameter for insertion.

The first foldable beach seat may comprise back attachment apertures on opposite sides of the back portion, and seat attachment apertures on opposite sides of the seat portion. In this manner, the first foldable beach seat may comprise back attachment apertures and seat attachment apertures on opposite sides of the beach seat. The opposing attachment apertures may be used to detachably attach a first armrest to a first side of the first foldable beach seat and to detachably attach a second armrest to a second side of the first foldable beach seat in order to produce a captain's chair beach seat.

A first attachment post may be configured to extend into the first armrest attachment aperture to couple the armrest to the back portion of the beach seat. A second attachment post may be configured to extend into the second armrest attachment aperture to couple the armrest to the seat portion of the beach seat. Various embodiments of the invention comprise various numbers of attachment posts that may be used to connect the armrest to various attachment apertures located on the first foldable beach seat. Said various attachment apertures may be located on the back portion, seat portion, and/or leg portion.

A second foldable beach seat may be provided that is detachably attachable to the first foldable beach seat. The second foldable beach seat may be detachably attached to the first foldable beach seat by insertion of the attachment posts into corresponding attachment apertures between the beach seats.

The first foldable beach seat and the second foldable beach seat may each comprise a seat-back hinge that may be configured between the seat portion and the back portion. The first foldable beach seat and the second foldable beach seat may further comprise a seat-leg hinge configured between the seat portion and the leg portion. The seat-back hinges may comprise one or more seat-back hinge attachment apertures, and the seat-leg hinges may comprise one or more seat-leg hinge attachment apertures. The seat-back hinge attachment apertures and seat-leg hinge attachment apertures may each receive one end of one of one or more attachment posts that may be used to detachably connect the first foldable beach seat and the second foldable beach seat. The seat-back hinge attachment apertures and/or seat-leg hinge attachment apertures may also be used with the attachment posts to detachably attach one or more armrests to one or both of the foldable beach seats by means of the armrest attachment apertures.

The beach seat may comprise a seat cushion coupled to the seat portion, a back cushion coupled to the back portion, and/or a leg cushion coupled to the leg portion. In some embodiments that comprise all three of a back cushion, seat cushion, and leg cushion, these three cushions may be coupled together. In such embodiments, the back cushion, seat cushion, and leg cushion may be foldable to configure one cushion atop another.

Each foldable beach seat may comprise a seat-back hinge plate that may extend between the seat portion and the back portion. The length of the seat-back hinge plate may be greater than the thickness of the leg cushion.

Additional foldable beach seats and armrests may be added to create any number of combinations of beach seats. For example, two beach seats may be detachably attached to form a love seat and a third foldable beach seat may be added to form a sofa beach seat with two armrests. Two armrests may be added to a single beach seat to form a captain's chair beach seat. Also two armrests may be added to the loveseat beach seat or the sofa beach seat.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
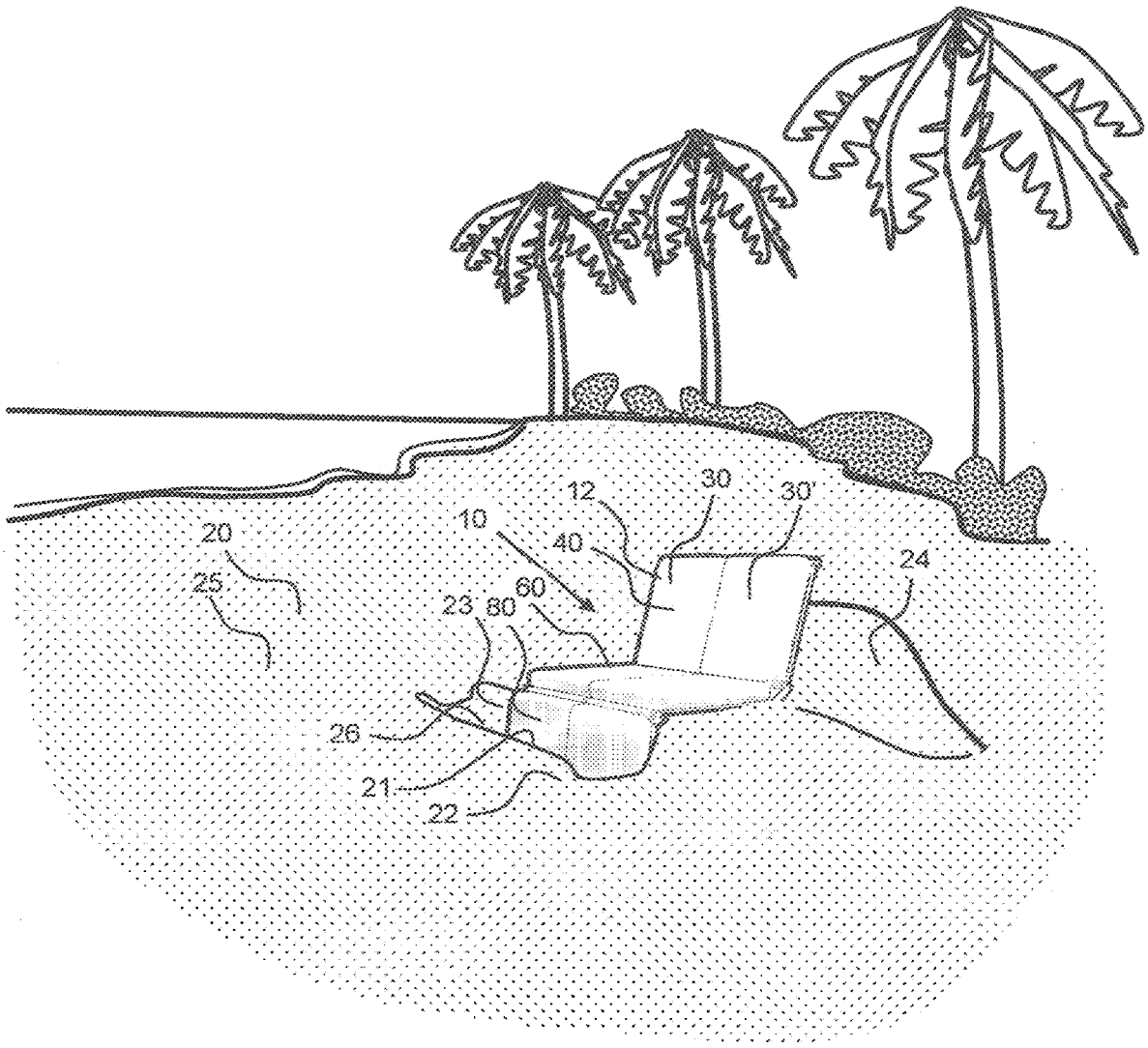
FIG. 1 shows a front side perspective view of an exemplary beach seat system having two beach seats coupled together as a loveseat, with the leg portions extended down into the trough in the beach.

Corresponding reference characters indicate corresponding parts throughout the several views of the figures. The figures represent an illustration of some of the embodiments of the present invention and are not to be construed as limiting the scope of the invention in any manner. Some of the figures may not show all of the features and components of the invention for ease of illustration, but it is to be understood that where possible, features and components from one figure may be included in the other figures. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown in FIG. 1, an exemplary beach seat system 10 has two beach seats 30, 30' coupled together as a loveseat 12, with the leg portions 80 extended down into the trough 26 in the beach 20. The trough is dug down below the beach surface 22 to form said trough having a front wall 21 and a back wall 23. The trough has a depth to receive the leg portion down along the back wall, and the sand removed may be used to create the sand-mound back rest 24 that is configured behind the back portion 40 of the beach seat. The seat portion 60 is configured between the leg portion and the back portion.

Figure 2:
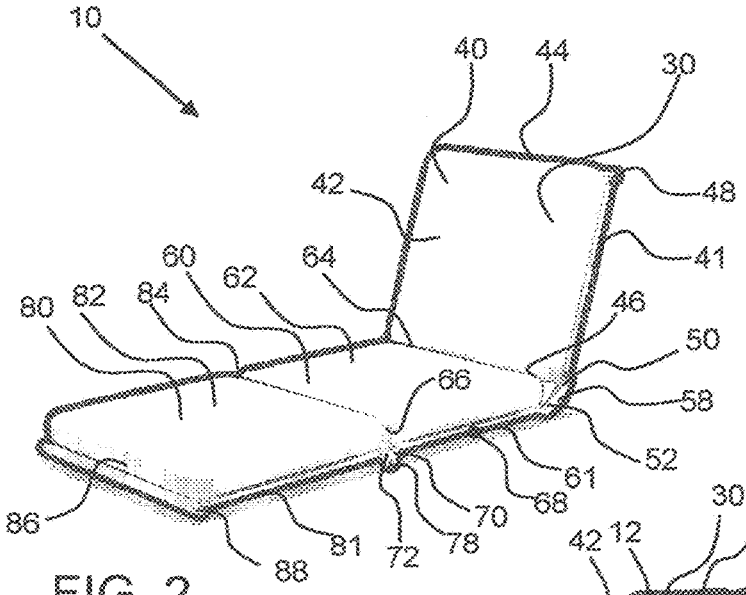
FIG. 2 shows a perspective view of a first beach seat having a back portion, seat portion and leg portion, and attachment apertures along the side for coupled a second beach seat thereto.
Figure 3:
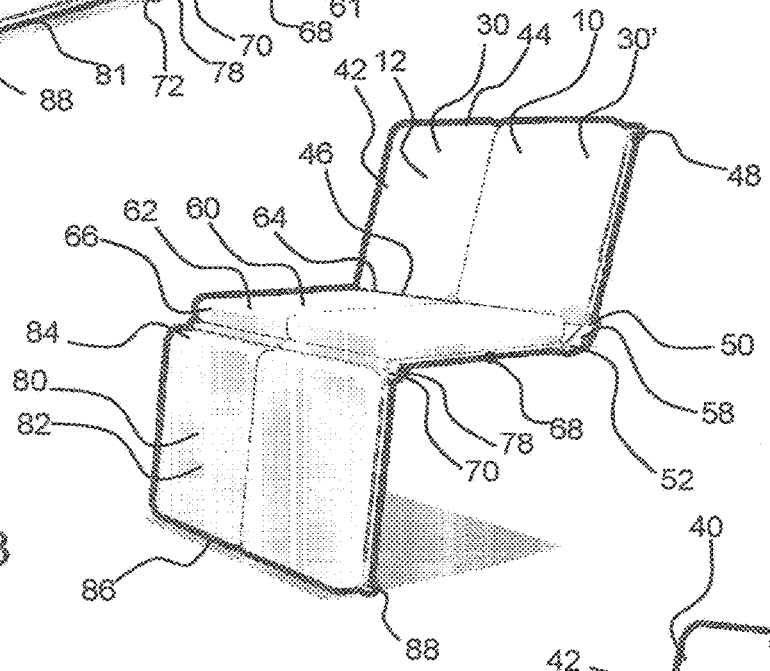
FIG. 3 shows a perspective view of the first beach seat shown in FIG. 2 coupled with the second beach seat shown in FIG. 4 to form a love seat.
Figure 4:
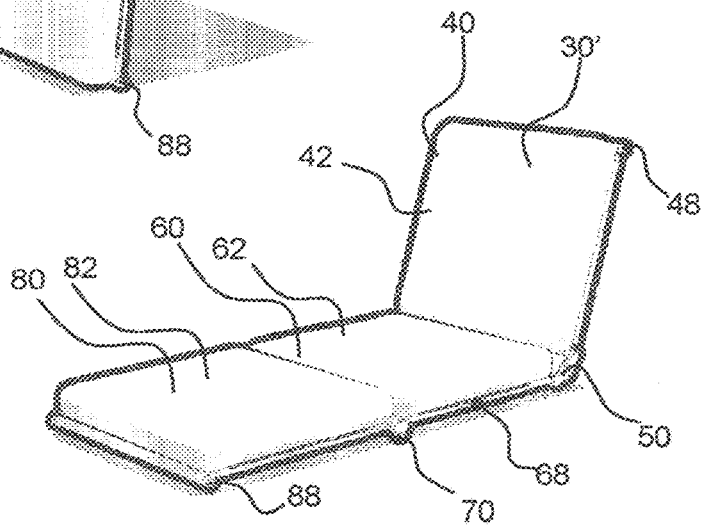
FIG. 4 shows a perspective view of a second beach seat having a back portion, seat portion and leg portion, and attachment apertures along the side for coupled a second beach seat thereto

Referring now to FIGS. 2 to 4, an exemplary beach seat system 10 has two beach seats 30, 30' coupled together as a loveseat 12, as shown in FIG. 3. Each of the individual beach seats 30, 30' has a back portion 40 that extends from an extended end 44 to back-seat end 46, a back frame 41 and a back cushion 42. The back portion also has a back attachment aperture 48 configured proximal to the extend end 44. Each of the individual beach seats 30, 30' has a seat portion 60 that extends between the back portion and the leg portion, or from the seat-back end 64 to the seat-leg end 66, a seat frame 61 and a seat cushion 62. The leg portion 80 extends from an extended end 86 to leg-seat end 84 and has a leg frame 81 and a leg cushion 82. The leg portion also has a leg attachment aperture 88 configured proximal to the extend end 86. A seat-back hinge 50 is configured between the back portion 40 and the seat portion 60 and enables the back portion to rotate or pivot with respect to the seat portion. A seat-back hinge plate 52 has a seat-back hinge attachment aperture 58 for receiving an attachment post to couple the two beach seats together. A seat-leg hinge 70, or seat-leg pivot, is configured between the seat portion 60 and the leg portion 80 and enables the leg portion to rotate or pivot with respect to the seat portion. A seat-leg hinge plate 72 has a seat-leg hinge attachment aperture 78 for receiving an attachment post to couple the two beach seats together.

Figure 10:
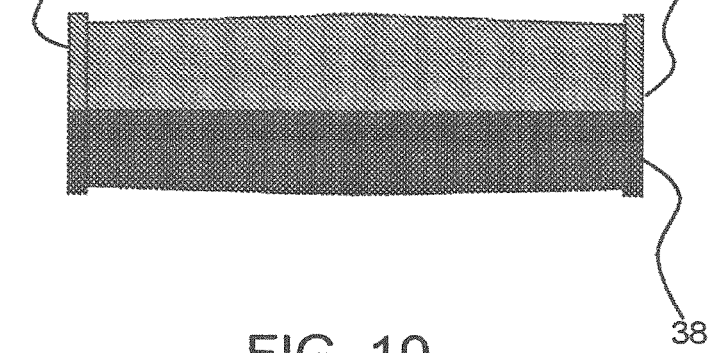
FIG. 10 shows a front view of an attachment post having a flared first end and second end and a slot to allow the attachment post to be squeezed to reduce the diameter of the attachment post for insertion into an attachment aperture.
Figure 11:
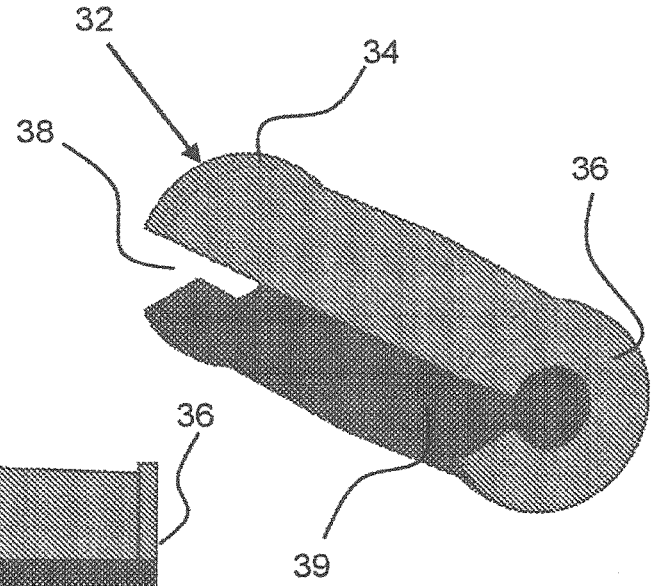
FIG. 11 shows a perspective view of the attachment post shown in FIG. 11.

As shown in FIG. 3, the first beach seat 30 is detachably attached to the second beach seat 30'. Attachment posts 32, shown in FIGS. 10 and 11, are configured between the two beach seats and extend into at least a portion of the attachment apertures of each of the beach seats to retain them together. An attachment post may extend into and between each of the back attachment apertures 48, the leg attachment apertures 88, the seat-back hinge attachment aperture 58, and the seat-leg hinge attachment aperture 78. Note, there may also be a seat attachment aperture 68 configured along the seat portion 60 and coupled with the seat frame 61.

Figure 5:
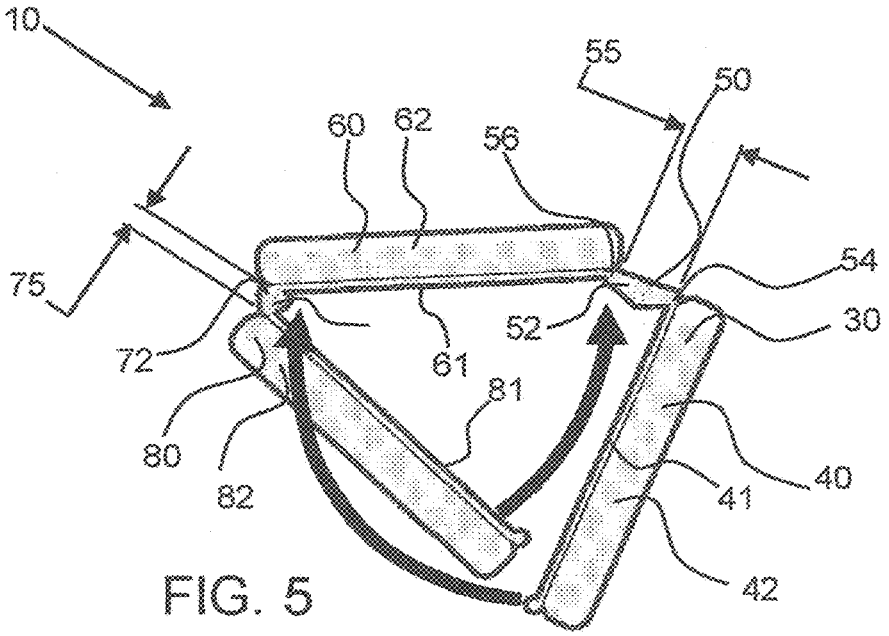
FIG. 5 shows a side view of a beach seat that is in the process of being folded.
Figure 6:
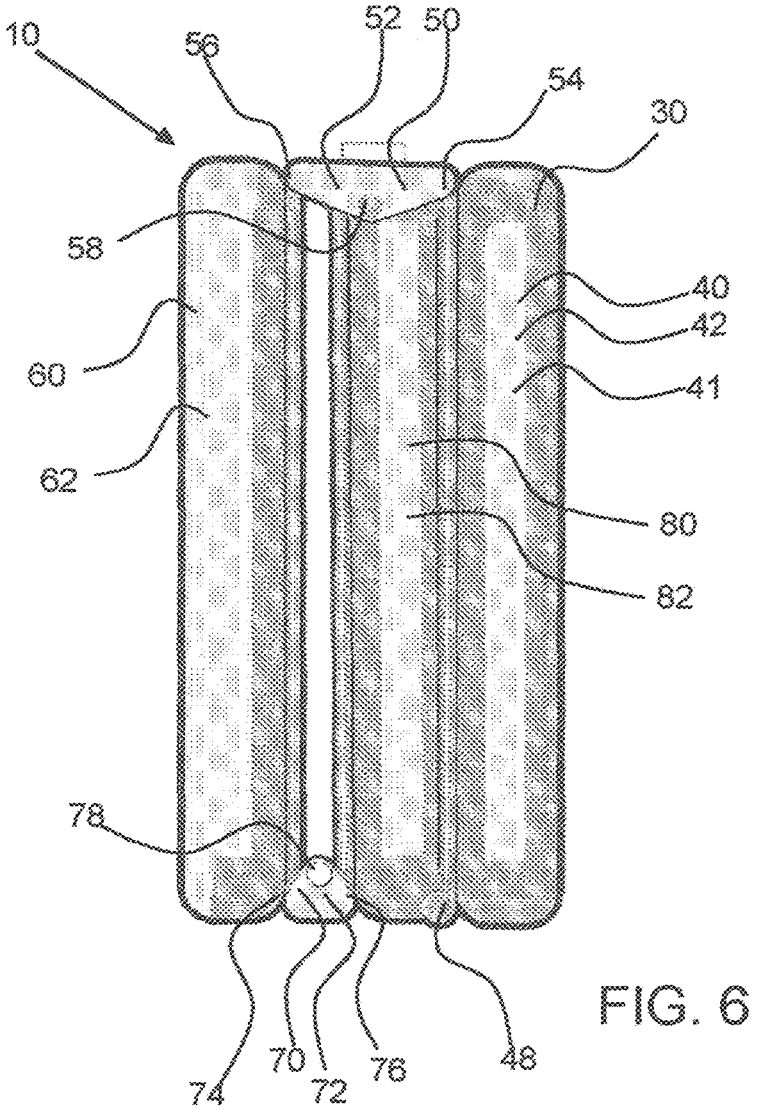
FIG. 6 shows a side view of the beach seat shown in FIG. 5 now folded with the leg portion folded up against the seat portion and the back portion folded down over the seat portion.

Referring now to FIGS. 5 and 6, an exemplary beach seat system 10 includes a beach seat 30 that has a back portion 40, seat portion 60, and a leg portion 80 coupled together by hinges. A seat-back hinge 50, or seat-back pivot, is configured between the back portion 40 and the seat portion 60 and enables the back portion to rotate or pivot with respect to the seat portion. A seat-back hinge plate 52 has a seat-back hinge attachment aperture 58 for receiving an attachment post to couple the two beach seats together. The seat-back hinge plate 52 is connected to the back portion 40 by means of a back hinge connection 54 and to the seat portion by means of a seat hinge connection 56, each of which may be pivots. A seat-leg hinge 70 is configured between the seat portion 60 and the leg portion 80 and enables the leg portion to rotate or pivot with respect to the seat portion. A seat-leg hinge plate 72 has a seat-leg hinge attachment aperture 78 for receiving an attachment post to couple the two beach seats together. The seat-leg hinge plate 72 is connected to the seat portion 60 by means of a seat hinge connection 74 and to the leg portion 80 by means of a leg hinge connection 76, each of which may be pivots.

The rotation of the back portion 40, seat portion 60, and leg portion 80 relative to one another allows the beach seat system 10 to fold in order to become more compact for transportation and/or storage, which each of the back, seat and leg portions stacked. The leg portion 80 is first pivoted relative to the seat portion 60 such that the leg portion 80 and seat portion 60 are stacked parallel with each other. The length 75 of the seat-leg hinge plate 72 allows the leg portion 80 and seat portion 60 to be parallel with each other when the beach seat system 10 is folded. The back portion 40 is then pivoted relative to the seat portion 60 so that the back portion 40 is stacked with and may rest flush against the leg portion 80. The length 55 of the seat-back hinge plate 52 allows the back portion 40 to be parallel with the seat portion 60 and the leg portion 80 when the beach seat system 10 is folded. The length is at least as great as the thickness of the leg portion to allow back portion to fold around the leg portion, as shown in FIG. 6. The back portion 40 has a back cushion 42 coupled to the back frame 41, the seat portion 60 has a seat cushion 62 coupled to the seat frame 61 and the leg portion 80 has a leg cushion 82 coupled to the leg frame. An exemplary beach seat 30 may be configured with one, two or all of the cushions. Note is some embodiments, the leg cushion and/or the back cushion is not included. Also, the cushions may be detachably attachable to the frame for storage and cleaning purposes.

Figure 7:
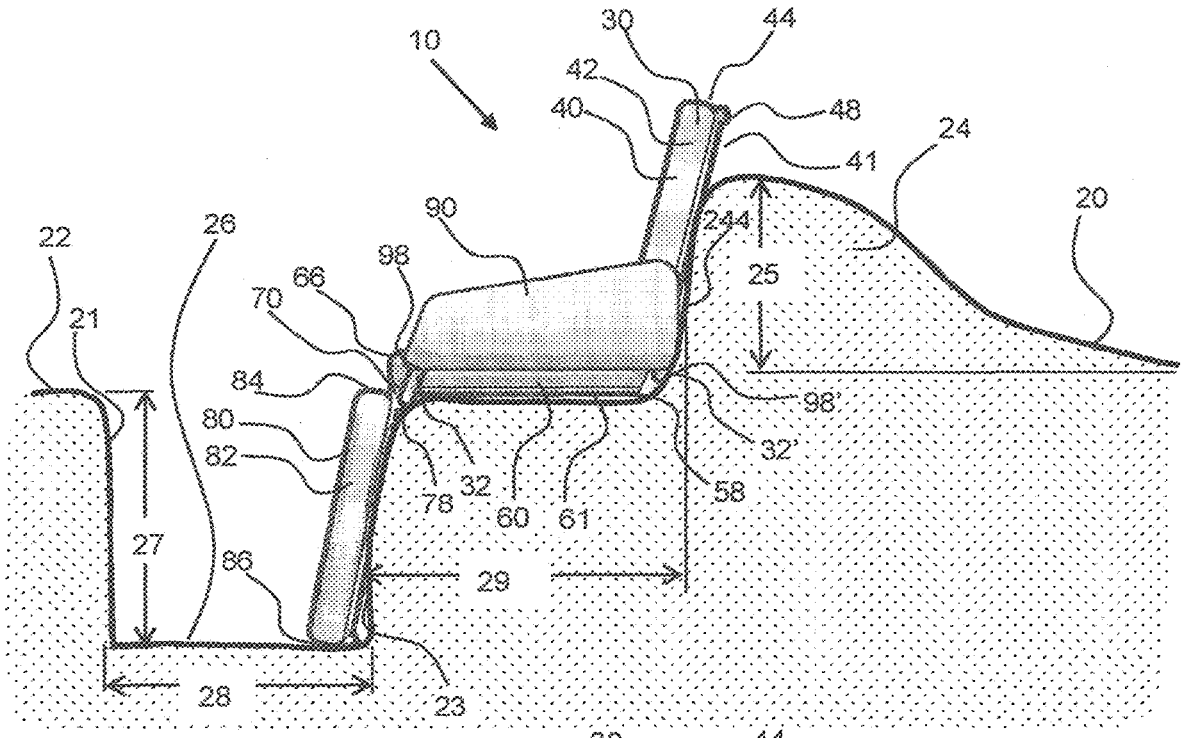
FIG. 7 shows a side view of a beach seat configured in a beach with the leg portion extended down into a trough in the beach and the back portion being supported by a sand-mound back rest, and an armrest being attached to the beach seat by attachment posts.
Figure 8:
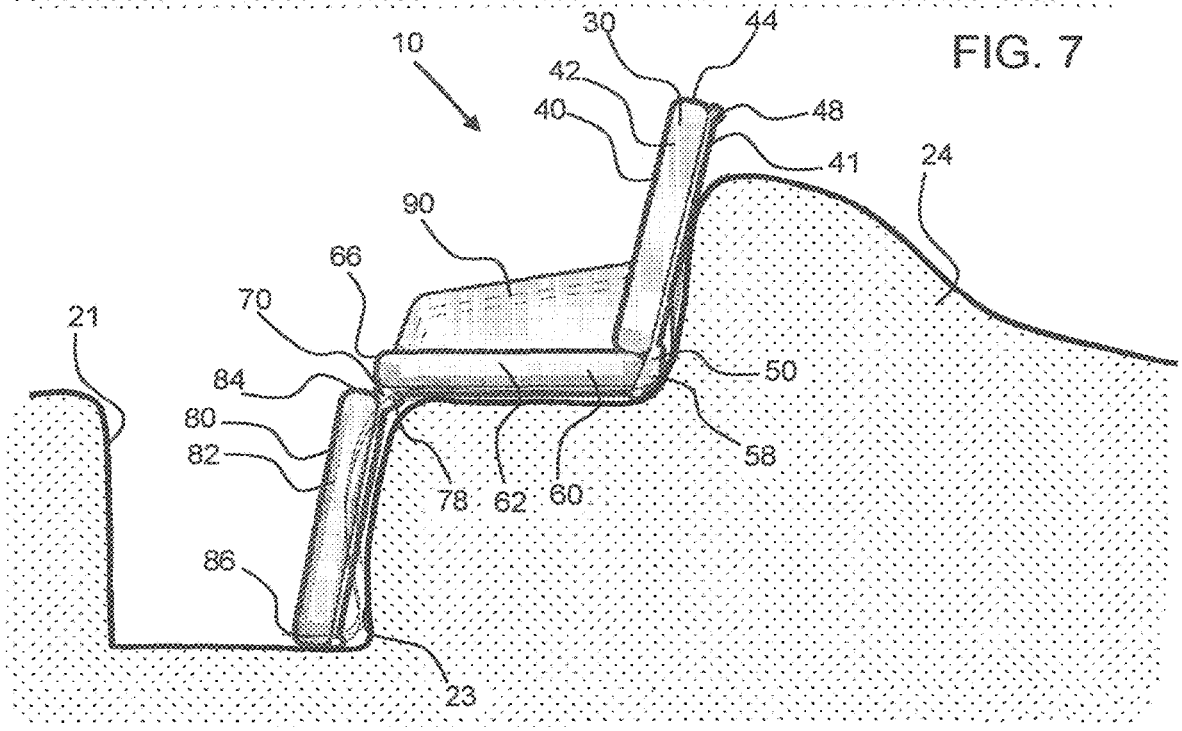
FIG. 8 shows a side view of the beach seat and armrest shown in FIG. 7 now detachably attached by the attachment posts.

Referring to FIGS. 7 and 8, a beach seat system 10 is shown with a back portion 40, seat portion 60, and leg portion 80 configured to form a beach seat 30 in the beach 20. The beach seat is arranged on a beach 20 with a trough 26 dug into the beach 20 into which the leg portion 80 of the beach seat system 10 is extended. The trough has a front wall 21 and a back wall 23. The trough has a depth 27 and a width 28. The depth is the length of the leg portion to allow the leg portion to extend down into the trough with the seat portion laying on the beach surface 22. Sand dug from the trough 26 may be used to create a sand-mound back rest 24 on which the back portion 40 of the beach seat system 10 rests. The sand-mound back rest wall 244, or back of the back portion of the beach seat may be configured an offset-seat distance 29 from the back wall 23 of the trough 26. The back wall 23 of the trough 26 and the sand-mound back rest 24 are separated by a width 28 on which the seat portion 60 of the beach seat system 10 rests. The sand-mound back rest may have a height 25 that is effectively tall to support the back portion. The height of the sand-mound back rest may be measured by laying a rigid board, such as a piece of plywood on the beach surface proximal the sand-mound back rest to establish the beach surface level, and then measuring from this rigid board to the top of the sand-mound back rest.

The beach seat system also has an armrest 90 that is being attached to the beach seat, as shown in FIG. 7. The armrest has armrest attachment apertures 98, 98' and an attachment post 32, 32' is inserted therein. The attachment post 32 is aligned with the seat-leg hinge attachment aperture 78 for insertion therein and with the seat-back hinge aperture 58 for insertion therein. The armrest is shown being detachably attached to the beach seat 30 in FIG. 8.

Figure 9:
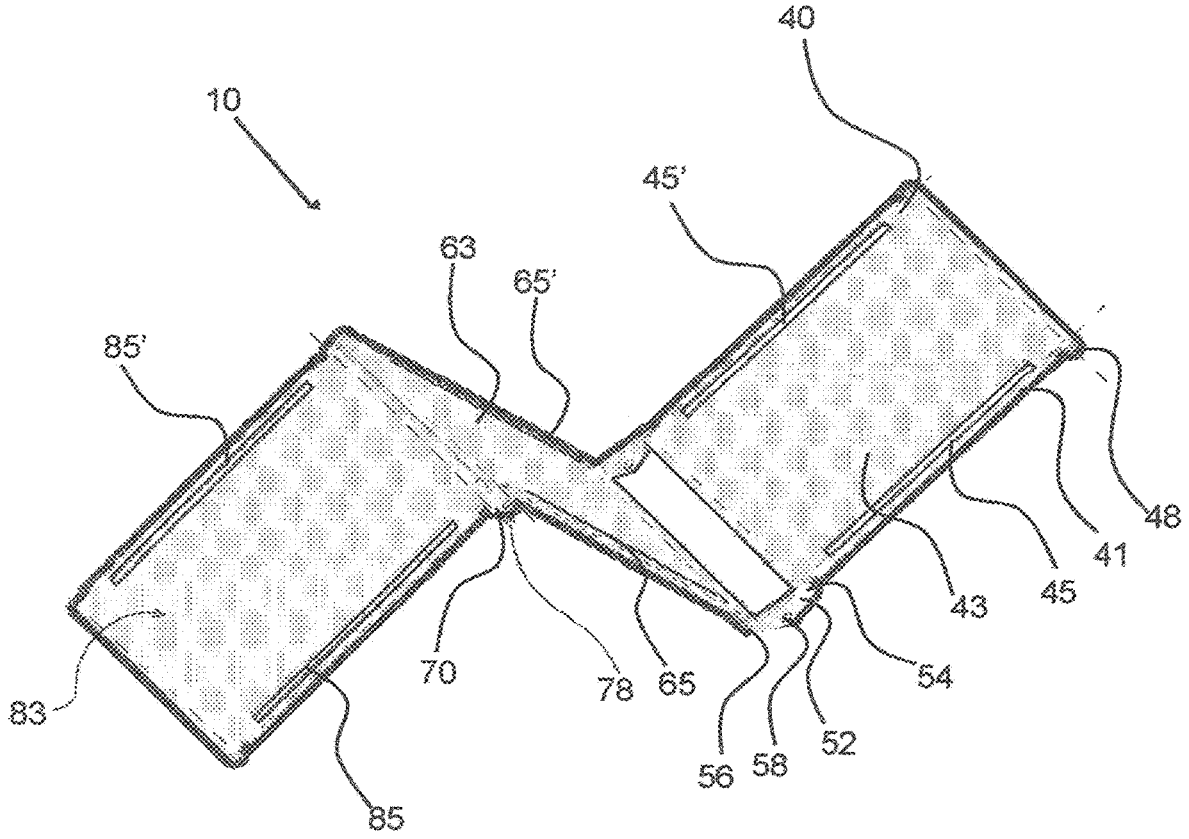
FIG. 9 shows a beach seat with the cushions removed to show the frame and panels extending across the frame.

Referring now to FIG. 9, a beach seat system 10 is shown with a back panel 43, seat panel 63, and leg panel 83 extending across the respective back frame 41, seat frame 61 and leg frame 81. The back panel 43 has two back panel slots 45, 45' that are used to connect a back cushion to the back panel. The seat panel 43 has two seat panel slots 65, 65' that are used to connect a seat cushion to the seat panel. The leg panel 83 has two leg panel slots 85, 85' that are used to connect a leg cushion to the leg panel. The back frame 41 and is connected to seat frame 61 by a seat-back hinge plate 52. The seat-back hinge plate has a back hinge connection 54, a seat hinge connection 56, and a seat-back hinge attachment aperture 58. The seat frame 61 is connected to the leg frame 81 by the seat-leg hinge 70, which has a seat-leg hinge attachment aperture 78.

Referring now to FIGS. 10 and 11, an attachment post 32 is shown with a first end 34, a second end 36, and a slot 38. The slot 38 runs from the first end 34 to the second end 36. The slot 38 enables the cylindrical cavity 39 within the attachment post 32 to close to reduce the diameter of the post for insertion into an attachment aperture.

Figure 12:
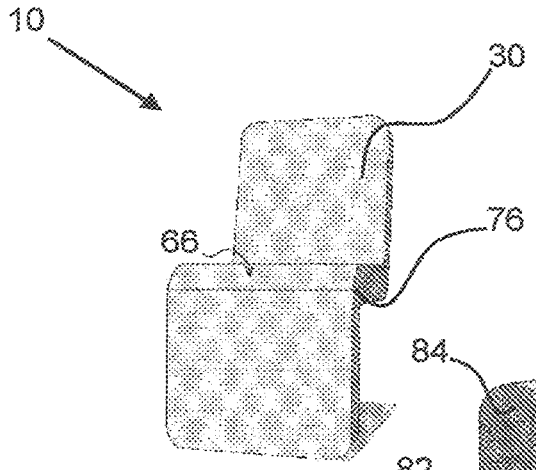
FIG. 12 shows a perspective view of a beach seat having a seat cushion that extends forward over the leg-seat end of the leg cushion.
Figure 13:
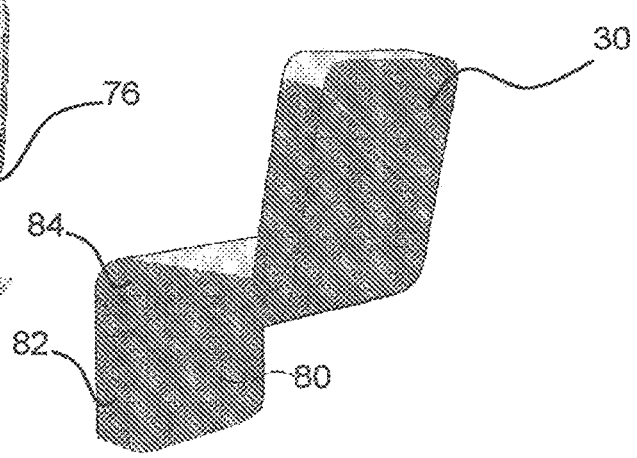
FIG. 13 shows a perspective view of the beach seat shown in FIG. 12.

Referring now to FIGS. 12 and 13, a beach seat 30 of a beach seat system 10 is shown in two different perspective views. The seat-leg end 66 of the seat portion 60 or the seat cushion 62 may be curved and/or extend to extend over the leg hinge connection 76 or leg-seat end 84 of the leg cushion 82.

Figure 14:
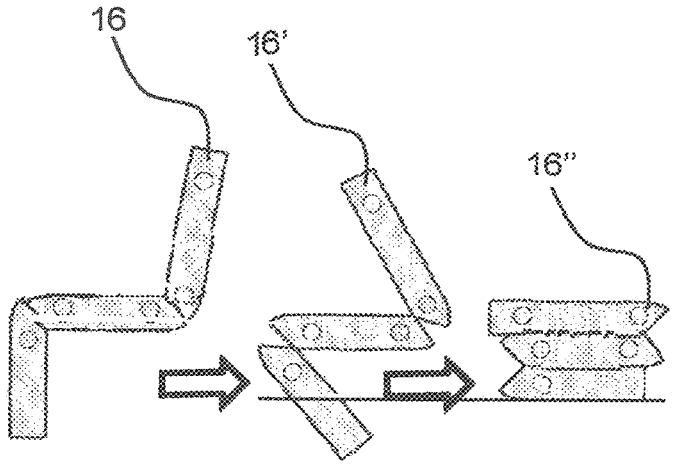
FIG. 14 shows a side view of a cushion assembly that is being folded for transport and storage.

Referring now to FIG. 14, a cushion assembly 16, 16', 16" is shown in multiple orientations. The cushion assembly may be coupled together such that the back cushion 42, the seat cushion 62 and leg cushion 82 are attached, or detachably attached to each other, such as by hook-and-loop fastener. The cushion assembly may be configured to fold as shown, for storage and transport.

Figure 15:
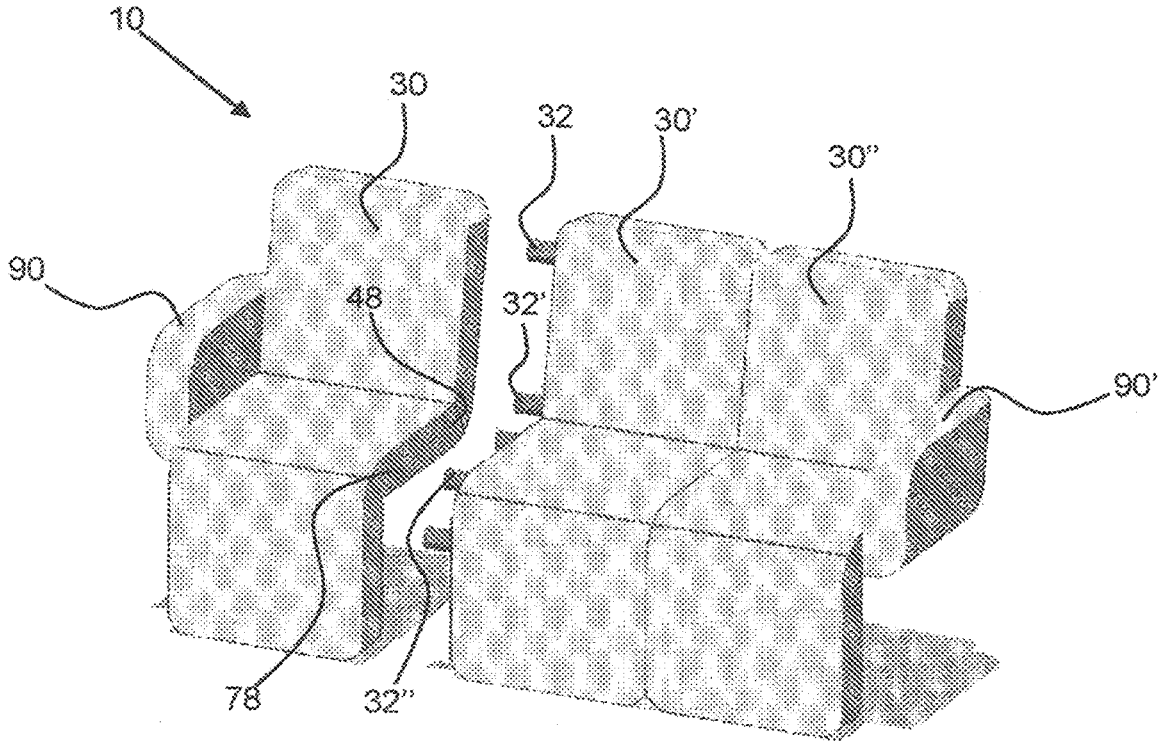
FIG. 15 shows a perspective view of pair of beach seats being coupled to a third beach seat by attachment posts that are extending out from the coupled beach seats.
Figure 16:
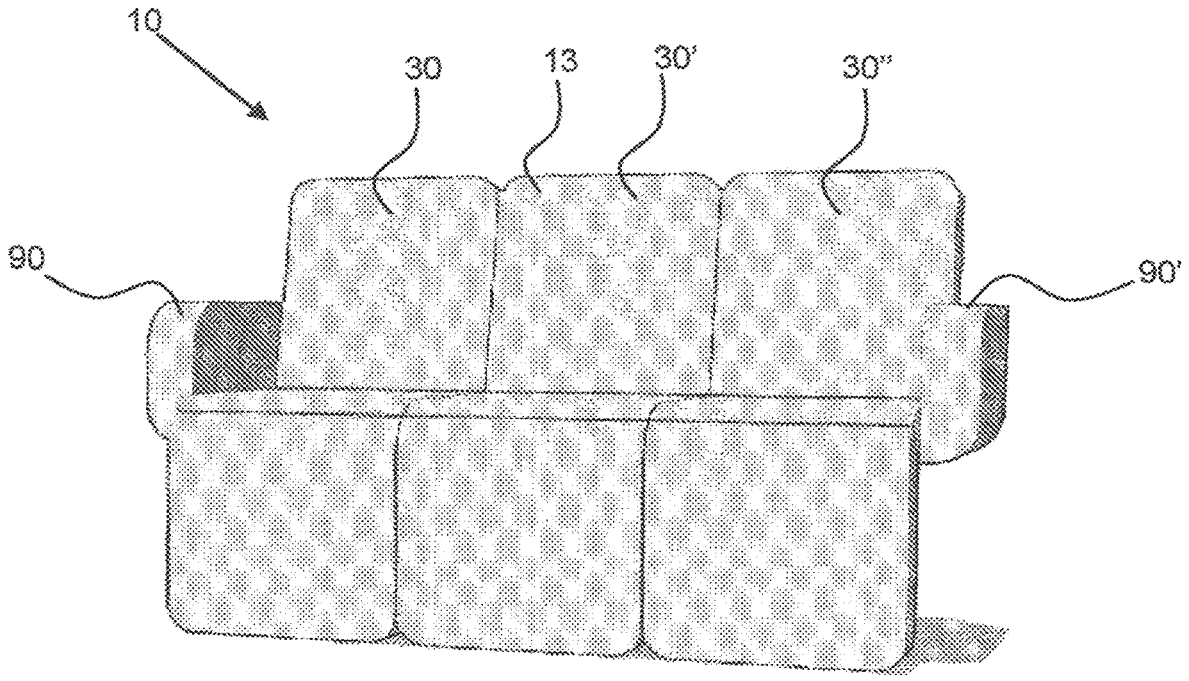
FIG. 16 shows a perspective view of three beach seats coupled together to form a sofa having an armrest on either said of the sofa.

Referring now to FIG. 15, two beach seats 30', 30" are detachably attached. An armrest 90' is connected to one of the beach seats 30". A plurality of attachment posts 32, 32', 32" are connected to the second beach seat 30', which are being used to connect a third beach seat 30 to the first two beach seats 30', 30". The attachment posts are configured to be inserted into and extend between attachment apertures of adjoining beach seats, including the back attachment aperture 48 and a seat-leg hinge attachment aperture 78. The attachment posts are inserted into the attachment apertures of the first beach seat 30' and are aligned with the attachment apertures of the third beach seat 30, for insertion therein. Another armrest 90 is connected to the third beach seat 30. FIG. 16 shows the beach seats 30, 30', 30" of FIG. 15 fully connected to form a sofa 13 with two armrests 90, 90'.

Figure 17:
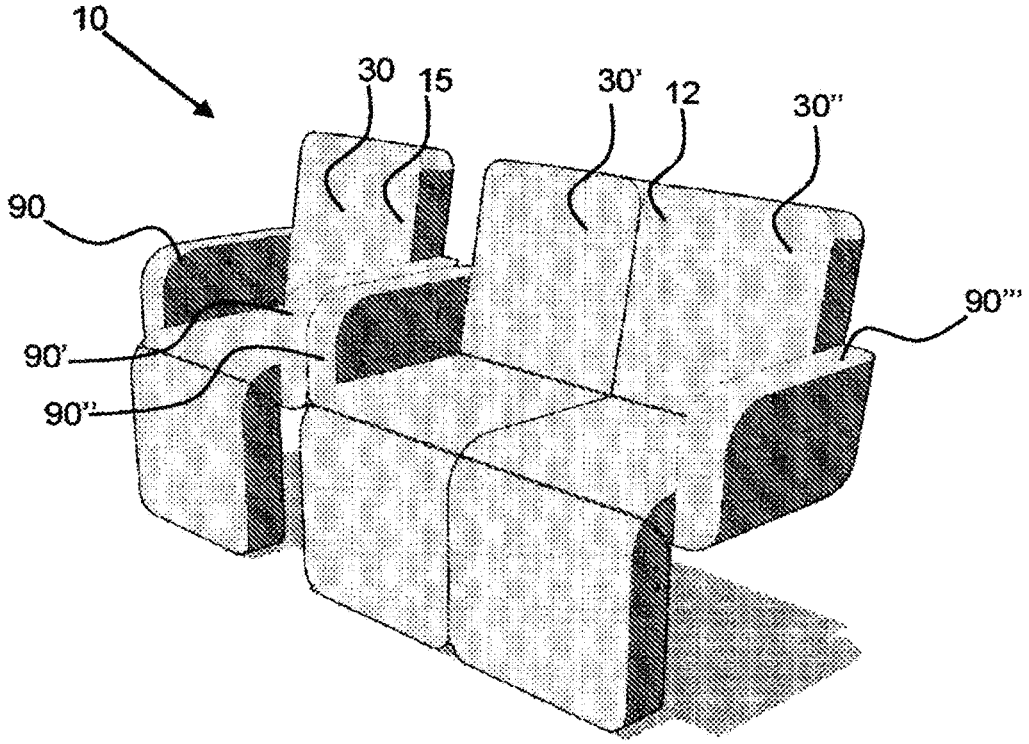
FIG. 17 shows a perspective view of a love seat being coupled to a captain's chair.
Figure 18:
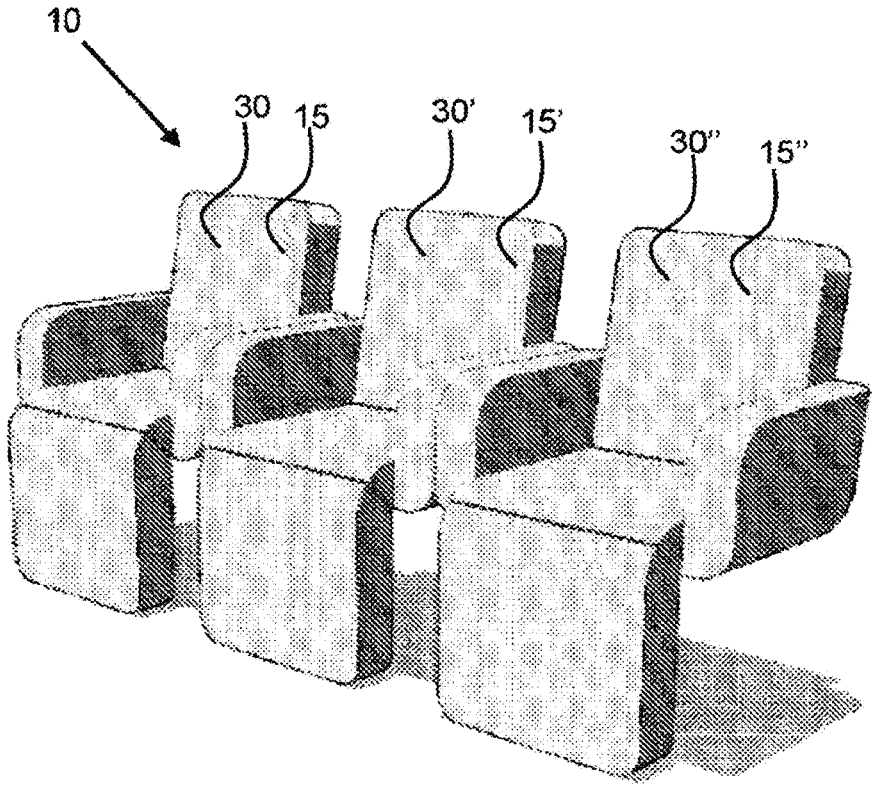
FIG. 18 shows three captain's chairs coupled detachably attached together to form stadium type seating.

FIGS. 17 and 18 also show three beach seats 30, 30', 30", except that in FIG. 17 two beach seats 30', 30" are arranged to form a loveseat 12 with two armrests 90", 90", and one beach seat 30 is arranged to form a captain's chair 15 with two armrests 90, 90'. In FIG. 18, all three beach seats 30, 30', 30" are arranged to form captain's chairs 15, 15', 15" with two armrests coupled to each. The armrests may have attachment aperture on opposing sides to enable the armrest to be coupled to a beach seat and then to another armrest or a second beach seat. Two sets of attachment posts may be required or the attachment posts may be long and extend through an attachment aperture in the armrest to enable detachable attachment to two opposing items, beach seat or armrest.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A method of forming a beach seat comprising:

a) providing a beach seat system comprising:
   i) providing a first foldable beach seat comprising:
   a back portion;
   a leg portion having a leg portion length;
   a seat portion hingeably connected to the leg and back portions, whereby each of the back portion and leg portion is configured to fold over and overlap at least a portion of the seat portion;

b) providing a beach comprising sand and having a beach surface;

c) digging a trough down in said beach surface of said beach having:
   i) a front wall;
   ii) a back wall;
   iii) a width between the front and back walls that is effectively wide to walk therein;
   iv) a depth that is at least as deep as the leg portion length;

d) mounding sand to form a sand-mound an offset-seat distance from the back wall;

e) placing said first foldable beach seat in a folded and overlapped condition down into the trough with said leg portion the back wall;

f) folding the seat portion back to rest on said beach surface of the beach;

g) configuring the back portion up against the sand-mound to produce said beach seat;

wherein steps e, f, and g, respectively, are performed sequentially.

2. The method of forming a beach seat of claim 1, wherein the first foldable beach seat has a seat-back hinge between the back portion and the seat portion and a seat-leg hinge between the leg portion and the seat portion.

3. The method of forming a beach seat of claim 1, further providing an armrest that is detachably attachable to the first foldable beach seat.

4. The method of forming a beach seat of claim 3, wherein the arm rest is configured to extend from the back portion along the seat portion of the first foldable beach seat.

5. The method of forming a beach seat of claim 4, wherein the arm rest has a back coupling that is configured to detachably attach to the back portion of the first foldable beach seat and a seat coupling that is configured to detachably attach to the seat portion of the first foldable beach seat.

6. The method of forming a beach seat of claim 4, wherein the arm rest has a first armrest attachment aperture configured to detachably attach to the back portion of the first foldable beach seat and a second armrest attachment aperture configured to detachably attach to the seat.

7. The method of forming a beach seat of claim 6, further providing a first and a second attachment post, and wherein the first attachment post is configured to extend into the first armrest attachment aperture to couple the armrest to the back portion of the beach seat and wherein the second attachment post is configured to extend into the second armrest attachment aperture to couple the armrest to the seat portion of the beach seat.

8. The method of forming a beach seat of claim 6, further providing attachment posts, and wherein the armrest comprises armrest attachment apertures for receiving said attachment posts, wherein the attachment posts are detachably attachable to the arm rest and are configured to extend into said armrest apertures and into the seat attachment apertures.

9. The method of forming a beach seat of claim 6, further providing attachment posts, and wherein the armrest comprises armrest attachment apertures for receiving said attachment posts, wherein the attachment posts are detachably attachable to the arm rest and are configured to extend into said armrest apertures and into at least one seat attachment aperture and into at least one back attachment aperture.

10. The method of forming a beach seat of claim 8, wherein the first foldable beach seat comprises said seat attachment apertures in said back portion and said seat portion on opposing sides of the beach seat.

11. The method of forming a beach seat of claim 10, further providing first and second armrests, including said armrest, and detachably attaching said first armrest to a first side of the first foldable beach seat and detachably attaching said second armrest to a second side of the first foldable beach seat to produce a captain's chair beach seat.

12. The method of forming a beach seat of claim 1, further providing a second foldable beach seat that is detachably attachable to the first foldable beach seat.

13. The method of forming a beach seat of claim 12, further providing attachment posts, wherein each of the first foldable beach seat and second foldable beach seat comprises attachment apertures, each configured for receiving one of said attachment posts, to detachably attach the first beach seat to the second beach seat.

14. The method of forming a beach seat of claim 13, wherein the seat portion of both of the first and second beach seats, each comprise at least one seat attachment aperture.

15. The method of forming a beach seat of claim 13, wherein the seat portion of both of the first and second beach seats, each comprise two seat attachment apertures, one configured proximal the leg portion and one configured proximal to the back portion.

16. The method of forming a beach seat of claim 13, wherein the back portion of both of the first and second beach seats, each comprise at least one back attachment aperture.

17. The method of forming a beach seat of claim 16, wherein the seat portion of both of the first and second beach seats, each comprise a seat attachment aperture.

18. The method of forming a beach seat of claim 17, wherein the leg portion of both of the first and second beach seats, each comprise a leg attachment aperture.

19. The method of forming a beach seat of claim 16, wherein the seat portion of both of the first and second beach seats, each comprise two seat attachment apertures, one configured proximal the leg portion and one configured proximal to the back portion.

20. The method of forming a beach seat of claim 19, wherein the leg portion of both of the first and second beach seats, each comprise a leg attachment aperture.

21. The method of forming a beach seat of claim 12, further providing a plurality of attachment posts and wherein each of the first and second beach seats comprise a seat-back hinge configured between the seat portion and the back portion, and a seat-leg hinge configured between the seat portion and the leg portion, and wherein the seat-back hinge comprises a seat-back hinge attachment aperture and wherein the seat-leg hinge comprises a seat-leg hinge attachment aperture, and wherein an attachment post of said plurality of attachment posts is configured to extend into and between the seat-back hinge attachment aperture and the seat-leg hinge attachment aperture of the first and second beach seat to detachably attach the first beach seat to the second beach seat.

22. The method of forming a beach seat of claim 21, further comprising attaching the first foldable beach seat to the second foldable beach seat by inserting the attachment posts into the seat-back hinge attachment aperture and into the seat-leg hinge attachment aperture of each of the first and second beach seats.

23. The method of forming a beach seat of claim 22, further providing an armrest and wherein the armrest comprises an armrest attachment aperture for receiving said attachment posts to detachably attach the armrest to one of the first beach seat or second beach seat with the attachment posts extending between the armrest attachment aperture and at least one of the seat-back hinge attachment aperture and the seat-leg hinge attachment aperture.

24. The method of forming a beach seat of claim 22, further providing an armrest and wherein the armrest comprises armrest attachment apertures for receiving said attachment posts to detachably attach the armrest to one of the first beach seat or second beach seat with an attachment post, from said plurality of attachment posts extending between the armrest attachment aperture and into each of the seat-back hinge attachment aperture and the seat-leg hinge attachment aperture.

25. The method of forming a beach seat of claim 1, wherein the beach seat comprise a seat cushion coupled to the seat portion.

* * * * *